United States Patent [19]

Swenson

[11] Patent Number: 4,976,464

[45] Date of Patent: Dec. 11, 1990

[54] FUEL-FIRED HEAT PUMP SYSTEM

[75] Inventor: Paul F. Swenson, Shaker Heights, Ohio

[73] Assignee: Consolidated Natural Gas Service Company, Inc., Pittsburgh, Pa.

[21] Appl. No.: 321,893

[22] Filed: Mar. 10, 1989

[51] Int. Cl.[5] ..... F25B 27/00

[52] U.S. Cl. ..... 237/81; 237/2 B; 62/323.1

[58] Field of Search ..... 237/2 B, 81; 62/323.1, 62/238.6, 324.1

[56] References Cited

U.S. PATENT DOCUMENTS

Re. 31,281 6/1983 Swenson et al. ..... 62/160

4,517,799 5/1985 Hanaoka et al. ..... 62/238.6

*Primary Examiner*—Henry A. Bennet

*Attorney, Agent, or Firm*—Pearne, Gordon, McCoy & Granger

[57] ABSTRACT

A heating system that reduces the cycling losses of a heat engine driven heat pump by storing rejected heat from the engine and using this rejected heat to meet a heating demand between periods of operation of the engine and heat pump so that over an extended time fewer start/stop cycles of the engine and heat pump are necessary. In a preferred embodiment a conventional storage-type hot water heater is used to store rejected heat, provide potable hot water, supply heat in the event of failure of the heat pump, supplement heat in periods of unusual demand, and provide low level heating requirements when heat pump operation would not be economical.

8 Claims, 1 Drawing Sheet

FUEL-FIRED HEAT PUMP SYSTEM

BACKGROUND OF THE INVENTION

The seasonal performance of natural gas fuel-fired heat pumps in residential space heating installations has often been relatively low. In some instances, a seasonal heating coefficient of performance of only slightly more than one can be experienced. This means that the heat pump delivers perhaps only 10 to 20% more heat to a house than the fuel value of the gas used by the heat pump. When the electrical fans and pumps associated with the gas heat pump are accounted for, it may actually cost more to operate the heat pump than a high efficiency gas furnace, boiler or hydronic water heater. The steady state coefficient of performance of a typical gas fired heat pump can be relatively high, for example, approaching the range of 1.8. It is believed that the loss of efficiency is related to cycling losses which occur when the house thermostat comes on for relatively short cycles of typically 10 to 15 minutes and then shuts off for perhaps another 15 to 20 minutes. Since the heat pump mechanism is largely outside, every time it shuts off heat runs back from the house through the piping and is dissipated outdoors. Additionally, the prime mover or engine cools off so that when restarted it sacrifices efficiency for a minute or few minutes until it warms up to a normal operating temperature.

SUMMARY OF THE INVENTION

The invention provides a heat pump system driven by a fuel-fired prime mover that operates cyclically with a substantial improvement in efficiency. In accordance with the invention, operating efficiency is improved by providing a heat storage unit that stores heat rejected by the prime mover. This stored heat is used in periods intervening the periods of operation of the prime mover and heat pump.

One effective method of operation, according to the invention, is to operate the heat pump until a demand is satisfied, and then utilize the stored prime mover rejected heat for the subsequent demand cycle. Thus, every other heat demand cycle is satisfied by the heat pump and intervening heat demand cycles are satisfied by the store of rejected heat. A significant increase in the coefficient of performance from, for example, 1.1 or 1.2 associated with the prior art to approximately 1.6 for the heating system of the present invention can be expected. This performance level represents nearly a 50% increase in efficiency.

As disclosed, the heat pump system is particularly suited for residential space heating. Further, the system advantageously employs a conventional gas-fired storage type domestic hot water heater as a heat storage unit for rejected heat from the prime mover. Use of a conventional storage-type hot water heater, according to the invention, yields several desirable functions. First, the hot water heater provides storage for rejected heat from the fuel-fired prime mover of the heat pump system. Second, the hot water heater serves its usual function of providing hot potable water. Third, the hot water heater provides back-up heat while the heat pump is in a defrosting mode or in emergency situations such as when the heat pump becomes disabled. Fourth, the hot water heater can produce supplemental heat at times of extremely heavy demand beyond the capacity of the heat pump or at times of very light load when the heat pump would be required to run for only a very short period. Use of a conventional storage-type hot water heater has the further advantage of significant cost reduction since widespread mass production of such heaters exists.

DESCRIPTION OF THE PREFERRED EMBODIMENT

Figure 1:
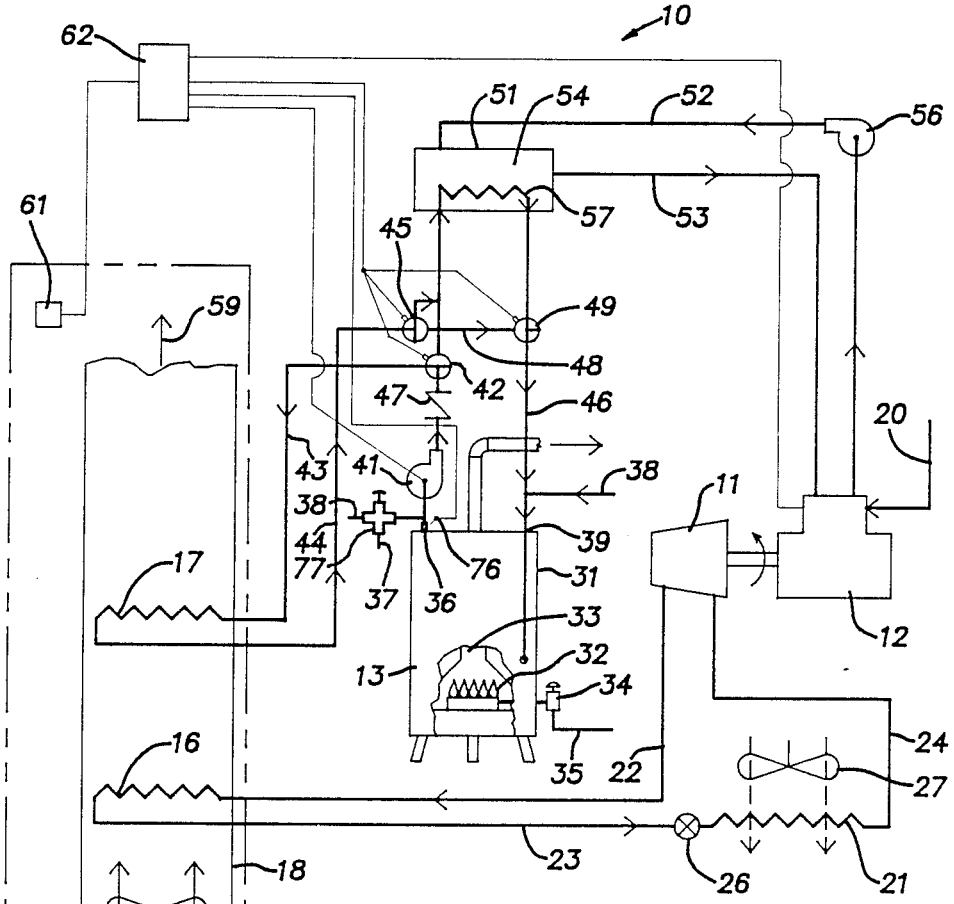
FIG. 1 is a schematic representation of a heating system embodying the invention.

FIG. 1 illustrates a heating system 10 suitable for space heating a residential area such as a house, apartment, office or like space. The system 10 includes a heat pump compressor 11 driven by a prime mover 12 and a storage-type hot water heater 13. The system 10 further includes heat exchanger coils 16 and 17 in a duct 18 through which air from the space being heated is circulated. The closed space being heated or conditioned by the system 10 is schematically illustrated by the broken line 19. The present disclosure involves heating service but it will be appreciated by those familiar with the art that suitable valves and control elements, known in the art, can be provided for operating the heat pump to cool the space 19 being conditioned. For example, U.S. Reissue Pat. No. 31,281, illustrates suitable valving for reversing the heat pump heat exchangers.

The prime mover 12 is an internal combustion engine or other heat engine such as a Stirling, steam or gas turbine driven unit and is preferably fueled by natural gas or other combustible fuel supplied by a line 20. The illustrated heat pump compressor 11 is preferably a refrigerant vapor compressor producing a reverse Rankine vapor compression cycle. It will be understood that various types of compressors such as reciprocating, screw, vane or centrifugal can be used. Further, a reverse Brayton heat pump cycle can also be used.

In heating service, a refrigerant fluid, when the heat pump compressor 11 is operating, circulates through the heat exchanger 16 located in the air duct 18 and through another coil or heat exchanger 21 located outdoors and interconnecting lines 22–24. Heat is absorbed by the refrigerant fluid at the outdoor heat exchanger 21 and is exchanged from this fluid to air at the indoor heat exchanger 16. A refrigerant liquid expansion valve 26 in the line 23 causes the refrigerant to enter the outdoor heat exchanger partially vaporized at low pressure and low temperature. The outdoor coil 21 is in heat exchange relation to outdoor air which may be circulated across the coil by a powered fan 27. Alternatively, the outdoor coil 21 may be in heat exchange relation with sub-surface media such as ground water or with a solar pond. Heat absorbed by the refrigerant as it passes through the coil 21 causes it to be vaporized. The compressor elevates the pressure of the vaporized refrigerant and, therefore, the condensing temperature of the refrigerant fluid before it enters the heat exchanger 16. The refrigerant condenses in the heat exchangers 16 giving up heat.

Relatively high temperature heat storage is preferably provided by the unit 13 in the form of a conventional commercially available storage-type hot water heater. Particularly suited for this application are appliances which comply to American National Standards Institute standard Z-21.10.

The water heater 13 includes a tank 31 with a capacity in the range of 30–50 gallons, for example, and a burner 32 with a capacity in the range of 36,000 to 100,000 btu/hr., for example, centrally located at the bottom of the tank 31. The burner 32 mixes natural gas from a supply line 35 and air and supports combustion of the same. Combustion products from the burner 32 pass through a vertical stack 33 through the center of the tank 31 to heat water stored therein in a known manner.

A conventional thermostatic control valve 34 responds to the temperature of water in the tank 31 and operates the burner 32 whenever the temperature falls below a predetermined limit, for example, 120° F. An outlet 36 on the heater tank 31 supplies hot water through a line 37 to sink taps and the like at the space 19. A source of cold potable water, such as a public utility line, supplies an inlet 39 of the tank 31 through a line 38 to make up for water use at the taps.

A pump 41 operates to circulate hot water stored in the tank 31 through the heat exchanger 17 in the air duct 18. The pump 41 with its inlet connected to the tank outlet 36 circulates the hot water through a first electrically controlled 2-position valve 42, a line 43 to the heat exchanger 17, a line 44 from the heat exchanger to a second electrically controlled 2-position valve 45, a line 48, a third electrically controlled 2-position valve 49 and then through a line 46 to the tank inlet 39. A check valve 47 prevents thermo siphon induced flow between the pump 41 and valve 42 during periods when the pump is not operating.

A liquid-to-liquid heat exchanger 51 is arranged to transfer heat rejected by the engine 12 to water stored in the tank 31. The heat exchanger 51 eliminates mixing of engine coolant with potable water in the tank 31 for health reasons. In the illustrated case, engine coolant circulates through lines 52 and 53 to and from a shell 54 of the heat exchanger 51. If desired, this coolant can be arranged to receive heat from the engine exhaust of combustion products in an exhaust gas heat exchanger in a known manner. A pump 56 operates whenever the engine 12 runs to circulate coolant through the shell 54. A coil 57 of the exchanger 51 is connected across the outlet 36 and inlet 39 of the tank 31 through the valves 42 and 49. The coil 57 is arranged to receive heat when available during engine operation from the engine coolant in the shell 54. Rejected heat from the engine 12 is available at a higher temperature than the temperatures reached by the heat pump refrigerant so that the heat exchanger 17 associated with the rejected heat and with the tank 31 is downstream of the heat pump heat exchanger 16 in the duct 18. A blower 58 circulates air from the space 19 being conditioned through the duct 18 in the direction indicated by the arrows 59 in order to heat this air at the exchangers 16, 17. The engine 12 and heat pump compressor 11 are ordinarily situated out of the enclosed space 19 and normally are housed in an outdoor enclosure.

A thermostat 61 monitors the temperature of air within the space 19 and provides a signal to a controller 62. Whenever the temperature in the space 19 is below a predetermined level, the controller operates the heating system 10 in a novel way to increase its operating efficiency. In accordance with the invention, the controller 62, in response to a signal from the thermostat 61 that there is a demand for heat, causes the engine 12 to start-up and drive the heat pump compressor 11 thereby moving heat from the outdoor coil 21 to the indoor duct coil 16. Thermostatic control switches (not shown) or a signal from the controller 62 causes the blower 58 to operate whenever hot fluid is in either of the coils 16 or 17 so that air within the space 19 is heated by such hot coil or coils. When the thermostat 61 signals the controller 62 that the demand for heat is satisfied, the engine 12 and heat pump 11 are shut off. Heat rejected by the engine 12 during its operation is transferred to the hot water coil 57 and, by operation of the pump 41 is conducted into the tank 31 where it is stored, or is conducted to the duct heat exchanger coil 17 where it is used to heat air, or it is transferred to both the tank 31 and duct coil 17 depending on the positions of the control valves 42, 45 and 49 as dictated by the controller 62.

Heat in the tank 31, in accordance with an important aspect of the invention, is used to heat the space 19 at appropriate times between periods of operation of the engine 12 and heat pump compressor 11. In a simple effective control strategy, the controller 62 for successive periods of heat demand alternates modes of heat supply between 1) operation of the heat pump 11 and 2) exchange of heat from water in the tank 31 without heat pump operation. In the latter mode, the controller 62 operates the pump 41 to circulate water from the tank 31 to the coil 17; also in this mode, the valves 42, 45 and 49 are preferably moved by the controller 62 to positions in which the coil 57 is bypassed by water circulating from the tank 31. During operation in the first mode, i.e. heat pump operation, heat rejected by the engine 12 depending on the positions of the valves 42, 45 and 49 as determined by the controller 62 can be stored in the tank 31, or simultaneously stored in the tank 31 and exchanged at the duct coil. The last of these options is performed when these valves 42, 45 and 49 are in their illustrated positions. This last option may be the preferred mode during the coldest weather when heat demand is high as the temperature of the air delivered to the space will be maximized. In the illustrated arrangement, all of the rejected heat of the engine 12 is routed through the tank 31 to be stored and/or transferred for use at the coil 17 or in potable hot water.

In a typical residential space of 800 to 3,000 square feet of floor space, the tank 31 can store sufficient heat energy in a 40–50 gallon volume of water in a temperature swing of 160° F. to 120° F., for example, to satisfy a moderate heat load for 15 to 20 minutes. By satisfying a heat demand with operation in the mode where the thermal energy is exclusively supplied from the tank 31, in accordance with the invention, the number of times in an hour or day that the heat pump must be energized is reduced. Consequently, the thermal cycling losses in starting up and shutting down the heat pump 11 are proportionately reduced. As much as a 50% increase in the seasonal coefficient of performance of the heat pump can be expected.

In addition to providing a convenient and economical heat storage means for heat rejected by the heat pump prime mover 12, the water heater 13 is available as a back-up heat source when the burner 32 operates. Additionally, the water heater burner 32 is available to supplement the heating capacity of the heat pump 11 at times of unusually high heat demand or during a defrost mode where the outdoor coil is heated by reverse operation of the heat pump circuit in a known manner or at times of relatively low heat demand where it is not comparatively economical to operate the heat pump 11 due to severe cycling losses. When heat demand in the space 19 is relatively low, for example, 20% or less than a design load, the controller 62 discontinues operation of the engine 12 and heat pump 11 and allows the burner 32 to supply required heat. Still further, the water heater serves its ordinary purpose of providing potable hot water.

Figure 2:
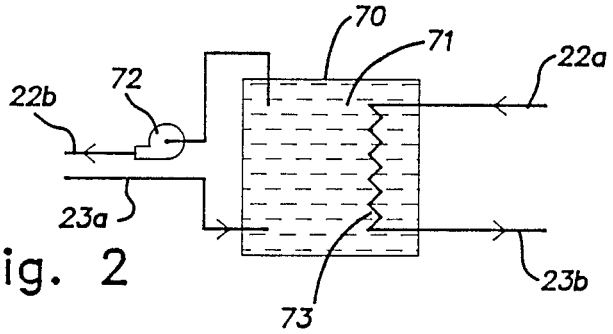
FIG. 2 is a schematic representation of a portion of a modified form of a space conditioning system embodying the invention.

Referring now to FIG. 2, a low temperature heat storage vessel 70 is interposed between the heat pump compressor 11 and the duct heat exchanger coil 16. Lines 22*a* and 22*b* correspond to the line 22 of FIG. 1 and, similarly, lines 23*a* and 23*b* correspond to the line 23 in FIG. 1. The vessel 70 contains a liquid such as water or a brine solution. Liquid 71 in the tank 70 is circulated through the duct coil 16 connected by the lines 22*a*, 23*a* by a pump 72 operated in response to a command from the controller 62. Refrigerant in the circuit of the heat pump compressor 11 and outside heat exchanger or evaporator 21 passes through a heat exchange coil 73 immersed in the liquid 71 in the tank or vessel 70. The low temperature heat storage vessel 70 affords greater flexibility of operation to the heating system 10 of FIG. 1. For example, the heat pump 11 can be run for periods longer than actual demand for heat exists so as to further reduce the number of times the heat pump compressor 11 is operated in a given time period so as to further reduce cycling losses. Additionally, the low temperature heat storage vessel 70 can be used as a cold storage when the heat pump 11 is operated for air conditioning, i.e. cooling the space 19 by reversing the roles of the heat exchangers 16 and 21 through appropriate valving and piping as the latter is taught in aforementioned U.S. Reissue Pat. No. 31,281, for example. A heat exchanger, piping and related controls (not shown) can be provided outdoors for discharging the rejected heat of the engine 12 in a known manner when the heat pump runs to cool the space 19 and the temperature of water in the tank 31 reaches a maximum set point monitored by a sensor probe 76 in the tank outlet 36 and connected to the controller 62.

This maximum temperature set point monitored by the sensor 76 is predetermined for the system and ordinarily will be at least 160° F. and not more than 200° F. A conventional thermostatic blending or tempering valve 77, preferably of the manually adjustable type, is provided in the outlet circuit of the tank 31 to limit the temperature of delivered potable water to 120° F., for example. The thermostatic burner control valve 34 originally supplied with the tank 31 is set to a temperature slightly below the tempering valve temperature to allow preferential use of rejected heat from the engine 12. The disclosed system with the tempering valve 77 and the storage tank 31 has a high utility when operating in a space cooling mode because rejected heat developed in a period of such operation can be stored temporarily for use in relatively short non-coincident demand periods for hot potable water.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A heating system for an enclosed space such as a house comprising a heat engine operatively connected to a heat pump compressor, a first heat exchanger in thermal communication with air in the space and connected to receive working fluid compressed by the compressor, a second heat exchanger in thermal communication with a zone outside the enclosed space and connected to receive working fluid from the first heat exchanger and to deliver it to an inlet of the compressor, thermal storage means for absorbing heat rejected by the heat engine, means for selectively transferring heat from the thermal storage means to the air in the space, and control means for establishing operation of said heat transferring means to conduct heat to said space from said storage means without operation of said heat engine and heat pump compressor in a period of heat demand following the termination of a period of operation of said heat engine and heat pump compressor satisfying a prior heat demand whereby thermal efficiency losses due to on and off cycling of said heat engine and heat pump compressor are reduced.

2. A heating system as set forth in claim 1, wherein said thermal storage means is a conventional storage-type hot water heater.

3. A heating system as set forth in claim 2, wherein said hot water heater includes a burner, said heat engine and burner both being arranged to combust natural gas.

4. A heating system as set forth in claim 2, including a thermostatic blending valve in a circuit connected to the outlet of the tank and a source of cold potable water, the thermostatic valve and the original burner control valve being set respectively at relatively low temperature settings and a temperature sensor separate from that of the burner control valve responsive to temperature of water in the tank of the heater and adapted to limit the temperature in the tank to a value in the order of 160° F. or greater whereby a relatively high amount of thermal energy from rejected heat from the engine can be stored in the tank and later used in potable water.

5. A method of heating a space comprising the steps of driving a heat pump with a fuel-fired prime mover to simultaneously heat the space and recover the waste heat from the prime mover and store the same in a heat storage unit, operating the heat pump in cycles spaced in time, heating air from the space with heat from the heat storage unit during periods of non-operation of the heat pump to reduce the number of cycles of operation required of the heat pump during an extended time period and thereby reduce the total cycling losses experienced in cyclic operation at the heat pump during such extended time period, a conventional domestic storage hot water heater with a self-contained fuel-fired heater being used as a heat storage unit for the heat recovery from the prime mover.

6. A method as set forth in claim 5, wherein the burner of the hot water heater is used to supplement heat supplied by the heat pump.

7. A method as set forth in claim 6, wherein both the prime mover and hot water heater are fueled with the same fuel source.

8. A method as set forth in claim 6, wherein during periods of low space heating load, periodic operation of the prime mover and heat pump is suspended and the fuel-fired heater is operated exclusively to satisfy the heating load.

* * * * *